US005121812A

United States Patent [19]

Ochiai et al.

[11] Patent Number: 5,121,812

[45] Date of Patent: Jun. 16, 1992

[54] FOLDING SCAFFOLD UNIT

[75] Inventors: Minoru Ochiai; Soichi Kiya; Mikio Takenoshita; Nobuyuki Kurosaki; Mitsuhiro Kishi, all of Tokyo, Japan

[73] Assignees: Takenaka Corporation, Osaka; Rental-No-Nikken Co., Ltd., Tokyo, both of Japan

[21] Appl. No.: 583,077

[22] Filed: Sep. 14, 1990

[30] Foreign Application Priority Data

Sep. 28, 1989 [JP] Japan ..... 1-253467

[51] Int. Cl.[5] ..... E04G 1/00; E06C 1/00

[52] U.S. Cl. ..... 182/152; 182/118; 182/222

[58] Field of Search ..... 182/152, 106, 151, 184, 182/53, 222, 124, 118, 113, 153, 178, 179; 108/127

[56] References Cited

U.S. PATENT DOCUMENTS 1,636,085 7/1927 Wittek ..... 182/118 X
2,062,473 12/1936 Norton ..... 182/152 X
2,781,527 2/1957 Landry ..... 5/177 X
3,150,741 9/1964 Salerno ..... 182/152
3,212,605 10/1965 Dickerson ..... 182/152 X
3,221,838 12/1965 Brayton ..... 182/178 X
3,312,305 4/1967 Waun ..... 182/152 X
4,534,447 8/1985 Champigny ..... 182/152

FOREIGN PATENT DOCUMENTS 7712343 5/1978 Netherlands ..... 182/152

*Primary Examiner*—Karen J. Chotkowski
*Attorney, Agent, or Firm*—Flynn, Thiel, Boutell & Tanis

[57] ABSTRACT

A folding scaffold unit having first and second pairs of poles each positioned perpendicular to the floor and parallel with each other, each pair of parallel poles being connected by connecting rods, scaffold boards being fixed to horizontal shafts at one ends thereof, the horizontal shaft being inserted into each pair of parallel poles and parallel with the connecting rods, the other horizontal shafts parallel with the horizontal shafts and rotatably connecting the other ends of the scaffold boards, a driving gear mounted on one of the pair of parallel poles for vertically swingably moving the scaffold boards, and gears fixed to the other horizontal shafts and having tooth flank meshing with each other.

15 Claims, 7 Drawing Sheets

FOLDING SCAFFOLD UNIT

BACKGROUND OF THE INVENTION

1. Field of the Invention

The present invention relates to a folding scaffold unit used by workers while constructing and/or repairing a structure while in a raised position and, particularly, to a folding scaffold unit which is foldable with ease and convenient for accommodation thereof when not in use.

2. Description of Prior Art

A scaffold unit has been conventionally needed in case that the worker is engaged in various working such as painting, repairing a wall surface of the structure, etc. at the position beyond the arms' length although the worker could engage in such working without using the scaffold unit within the arms' length.

There has been employed, as the scaffold unit, a group of logs combined by a wire and assembled at the working site or field or a group of metal pipes in view of improvement of working efficiency and reduction of costs. In the latter scaffold unit, namely, the one composed of the groups of the metal pipes, the pole members positioned perpendicular to the earth and scaffold boards to be fixed between the pole members are different members, hence, a plurality of members are assembled in the working field. Although this scaffold unit is stable after assembling the plurality of members, it takes labor and time for assembling the plurality of members before working and disassembling the plurality of members after working.

There has been employed a more simple scaffold unit composed of a plurality of stepladders and scaffold boards extended between the plurality of stepladders. This scaffold unit was likewise troublesome since the scaffold boards are disassembled and carried to the next working site.

There has been further employed a scaffold unit composed of a plurality of metal pipes which are welded and casters fastened to the underside of legs of the metal pipes to facilitate moving with ease. This is very convenient in case the scaffold unit is to be moved in the working field since if the scaffold unit is pushed along the wall of the structure, the casters move on the floor so that the scaffold unit can be moved faster which entails in completing the working faster. However, inasmuch as the scaffold unit is fabricated as a cubic structure which occupies a large space, it is still bulky when not used.

SUMMARY OF THE INVENTION

It is an object of the present invention to provide a folding scaffold unit capable of moving at the working site with ease, being assembled with ease, and being reduced in its size when not used.

To achieve this object, the folding scaffold unit according to the present invention comprises two pairs of poles positioned perpendicular to the floor or road surface, scaffold boards connected to the side surfaces of the pair of two poles, which boards oppose each other and are swingably vertically movable, a gear mechanism mounted on one end of the one pair of poles for swingably and vertically moving one of the scaffold boards and two pairs of gears respectively fixedly mounted on both the other ends of the scaffold boards and each having tooth flank meshing with each other.

The folding scaffold unit according to the present invention is characterized in that gears are fixedly mounted on tip ends of scaffold boards which are opposed to each other, each tooth flank of the gears are meshing with each other so that both of the scaffold boards are always movable in the same fan-shape angular interval while the opposed poles are always kept perpendicular to the floor or road surface.

The above and other objects, features and advantages of the present invention will become more apparent from the following description taken in conjunction with the accompanying drawings.

DETAILED DESCRIPTION

Figure 1:
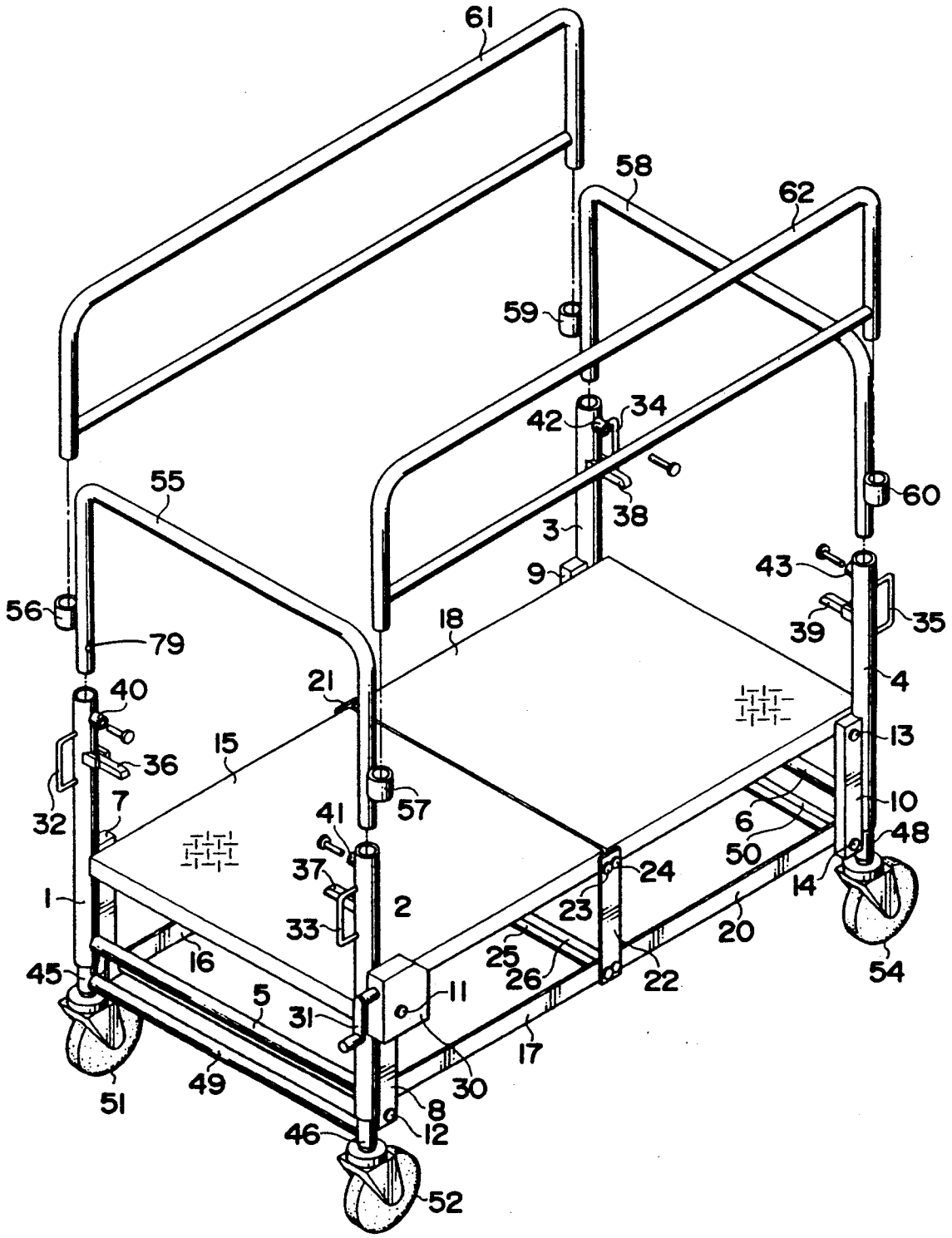
FIG. 1 is a perspective view showing a state where a folding scaffold unit is assembled.

A folding scaffold unit according to a preferred embodiment of the present invention will be described with reference to FIGS. 1 to 7.

The folding scaffold unit comprises two pairs of upright support rods or poles 1, 2 and 3, 4 positioned perpendicular to a road surface or a floor, scaffold boards 15, 18 connected to the side surfaces of the pair of poles 1, 2, 3, 4, which boards 15, 18 are opposed to each other and swingably vertically movable, a gear mechanism 80 and 81 (FIG. 6) mounted on one of the pair of poles 1, 2 for swingably and vertically moving one of the scaffold boards 15, 18, and two pairs of meshing gears 85, 86, 87, 88 respectively mounted on both the other ends of the scaffold boards 15, 18.

The folding scaffold unit will now be described more in detail.

The poles 1, 2 and 3, 4 are respectively hollow cylindrical pipes. One pair of poles 1 and 2 are vertically parallel and are fixedly connected by a horizontal connecting rod 5 at the lower portions thereof and formed substantially in U-shape. In the same way, the other pair of poles 3 and 4 are vertically parallel and are fixedly connected by a horizontal connecting rod 6 at the lower portions thereof and formed substantially in U-shape.

The poles 1 and 3 are opposed to each other while the poles 2 and 4 are opposed to each other. The poles 1, 2, 3 and 4 are positioned perpendicularly to the road surface or the floor. There are provided shaft supporting plates 7 and 8 each having thin elongate shapes and fixedly mounted on the poles 1 and 2 at the side surfaces thereof between the portion just lower than the centers thereof and the lower ends thereof. Likewise, there are also provided shaft supporting plates 9 and 10 each having thin elongate shapes and fixedly mounted on the poles 3 and 4 at the side surfaces thereof between the portion just lower than the centers thereof and the lower ends thereof. The shaft supporting plates 7 and 9 are opposed to each other while the shaft supporting plates 8 and 10 are opposed to each other.

There are rotatably pivotally mounted a horizontal shaft 11 between the shaft supporting plates 7 and 8 at the upper portions thereof and a horizontal shaft 12 at the lower portions thereof. Likewise, there are rotatably pivotally mounted a horizontal shaft 13 between the shaft supporting plates 9 and 10 at the upper portions thereof and a horizontal shaft 14 at the lower portions thereof. One end of scaffold board 15 is fixedly mounted on the shaft 11. There are pivotally mounted thin elongate operation plates 16, 17 on the shaft 12 at the right and left sides thereof. The operation plates 16, 17 each has a length substantially the same as that of the scaffold board 15 and positioned so as to be parallel with the scaffold board 15. One end of scaffold board 18 is fixedly mounted on the shaft 13. There are pivotally mounted thin elongate operation plates 19, 20 on the shaft 14 at the right and left sides thereof. The operation plates 19, 20 each has a length substantially the same as that of the scaffold board 18 and positioned so as to be parallel with the scaffold board 18.

Link plates 21, 22 are positioned at the other ends of the scaffold boards 15, 18 and extend downward. Horizontal shafts 23, 24 penetrate both the link plates 21, 22 at the upper portions thereof while horizontal shafts 25, 26 penetrate both the link plates 21, 22 at the lower portions thereof.

The inner edge of scaffold board 15 is movably connected to the shaft 23 supported by the link plates 21, 22 while the inner edge of scaffold board 18 is movably connected to the shaft 24 supported by the link plates 21, 22.

The operation plates 16, 17 are movably connected to the shaft 25 at the other end thereof while the operation plates 19, 20 are movably connected to the shaft 26 at the other end thereof. The shafts 11, 12, 23, 25 have respectively predetermined lengths to form parallelograms while the shafts 13, 14, 24, 26 have respectively predetermined lengths to form parallelograms.

A gear box 30 housing the worm gear 80 and the worm 81 therein is fixedly mounted on the outer side of the shaft supporting plate 8 and has a handle 31 for rotating the worm 81. There are fixedly mounted U-shaped grips 32, 33, 34, 35 on the upper side surfaces of the poles 1, 2, 3, 4. The worker can move the folding scaffold unit by pushing or pulling these grips 32, 33, 34, 35. There are fixedly mounted levers 36, 37 adjacent to the grips 32, 33 on the pair of poles 1, 2 in the confronting relation thereof while there are fixedly mounted levers 38, 39 adjacent to the grips 34, 35 on the pair of poles 3, 4 in the confronting relation thereof. There are fixedly mounted hole-defining elements 40, 41 on the pair of poles 1, 2 and positioned just above the levers 36, 37 in the confronting relation thereof for fixing a handrail, described later, while there are fixedly mounted hole-defining elements 42, 43 on the pair of poles 3, 4 and positioned just above the levers 38, 39 in the confronting relation thereof for fixing a handrail, described later.

Leg supporters 45, 46, 47, 48 are slidably inserted into lower end openings of the poles 1, 2, 3, 4 and connecting rods 49, 50 are provided between the leg supporters 45, 46, 47, 48 so that the leg supporters 45, 46 and the connecting rod 49 form substantially a U-shape and the leg supporters 47, 48 and the connecting rod 50 form substantially a U-shape. Casters 51, 52, 53, 54 are respectively mounted to the leg supporters 45, 46, 47, 48 at the lower ends thereof. The folding scaffold unit is freely movable on the floor or the road surface.

A lengthwise handrail 55 is formed by bending the pipe substantially in U-shape and has ring shaped joints 56, 57 at the side surfaces thereof and pin holes 79 below the joints 56, 57 and adjacent the lower ends thereof. The handrail 55 is movably inserted into the upper openings of the poles 1, 2. Likewise, a lengthwise handrail 58 is formed by bending the pipe substantially in U-shape and has ring shaped joints 59, 60 at the side surfaces thereof. The handrail 58 is movably inserted into the upper openings of the poles 3, 4. A widthwise handrail 61 is formed by bending the pipe substantially in U-shape and is movably inserted into the joints 56, 59 of the lengthwise handrails 55, 58. Likewise, a widthwise handrail 62 is formed by bending the pipe substantially in U-shape and is movably inserted into the joints 57, 60 of the lengthwise handrails 55, 58.

Figure 2:
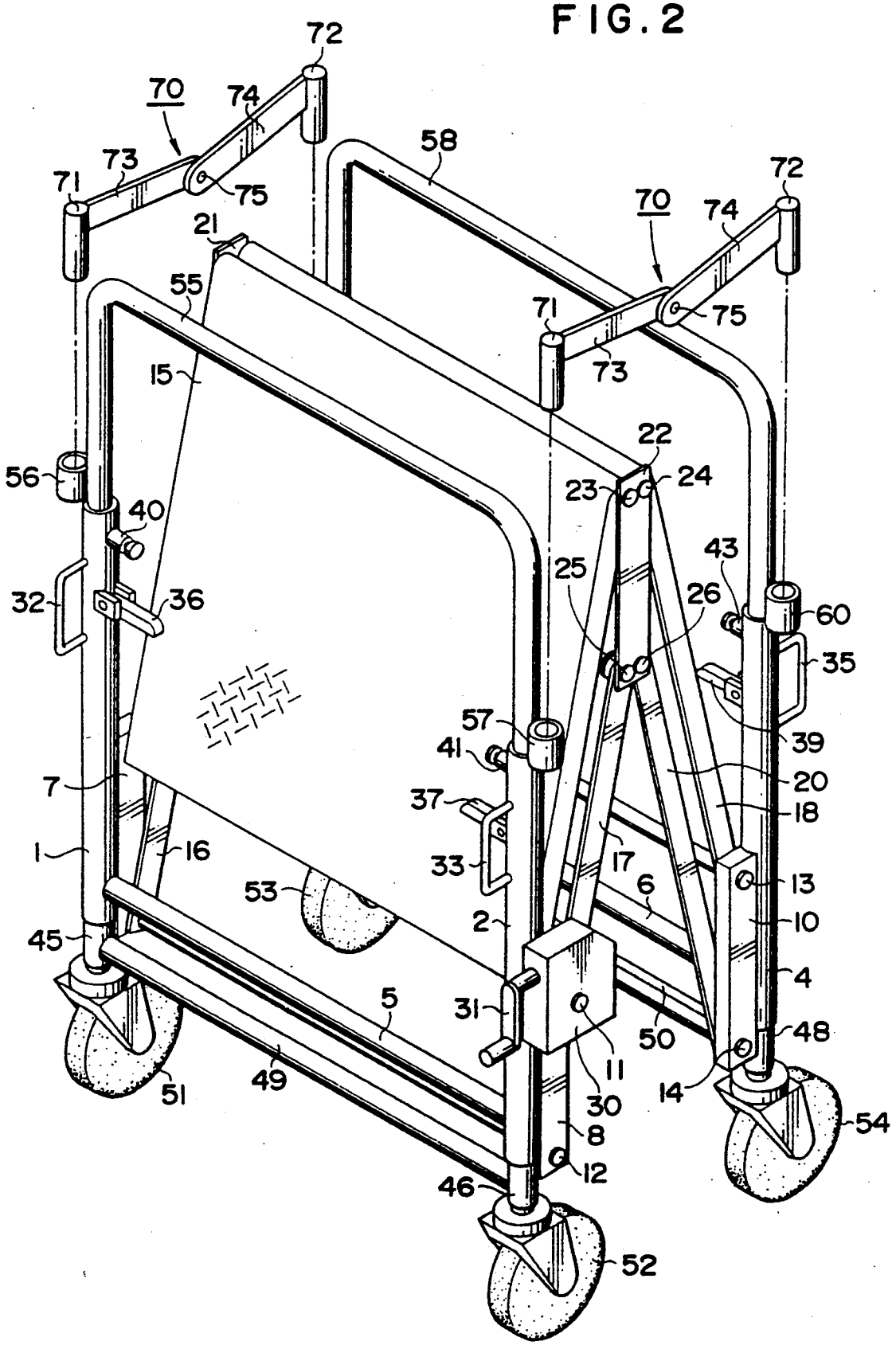
FIG. 2 is a perspective view showing a state where the folding scaffold unit is folded.

FIG. 2 shows a state where the folding scaffold unit is folded.

In FIG. 2, the widthwise handrails 61, 62 are removed from the joints 56, 59, 57, 60 and the poles 1, 3 are moved toward each other and the poles 2, 4 are moved toward each other. In this state, both the opposed poles 1, 3 and the opposed poles 2, 4 are temporarily fixed by connecting members 70, 70 so that the poles 1, 3 and the poles 2, 4 cannot be moved away from each other. Each of the connecting members 70, 70 comprises pins 71, 71, 72, 72 to be inserted into joints 56, 59 and joints 57, 60 and levers 73, 73, 74, 74 each fixed to the pins 71, 71, 72, 72 and pins 75, 75 for pivotally connecting the levers 73, 74. The spacing between the poles 1, 3 and 2, 4 is restricted to a small dimension by inserting the connecting members 70, 70 into the joints 56, 59 and the joints 57, 60.

Figure 5:
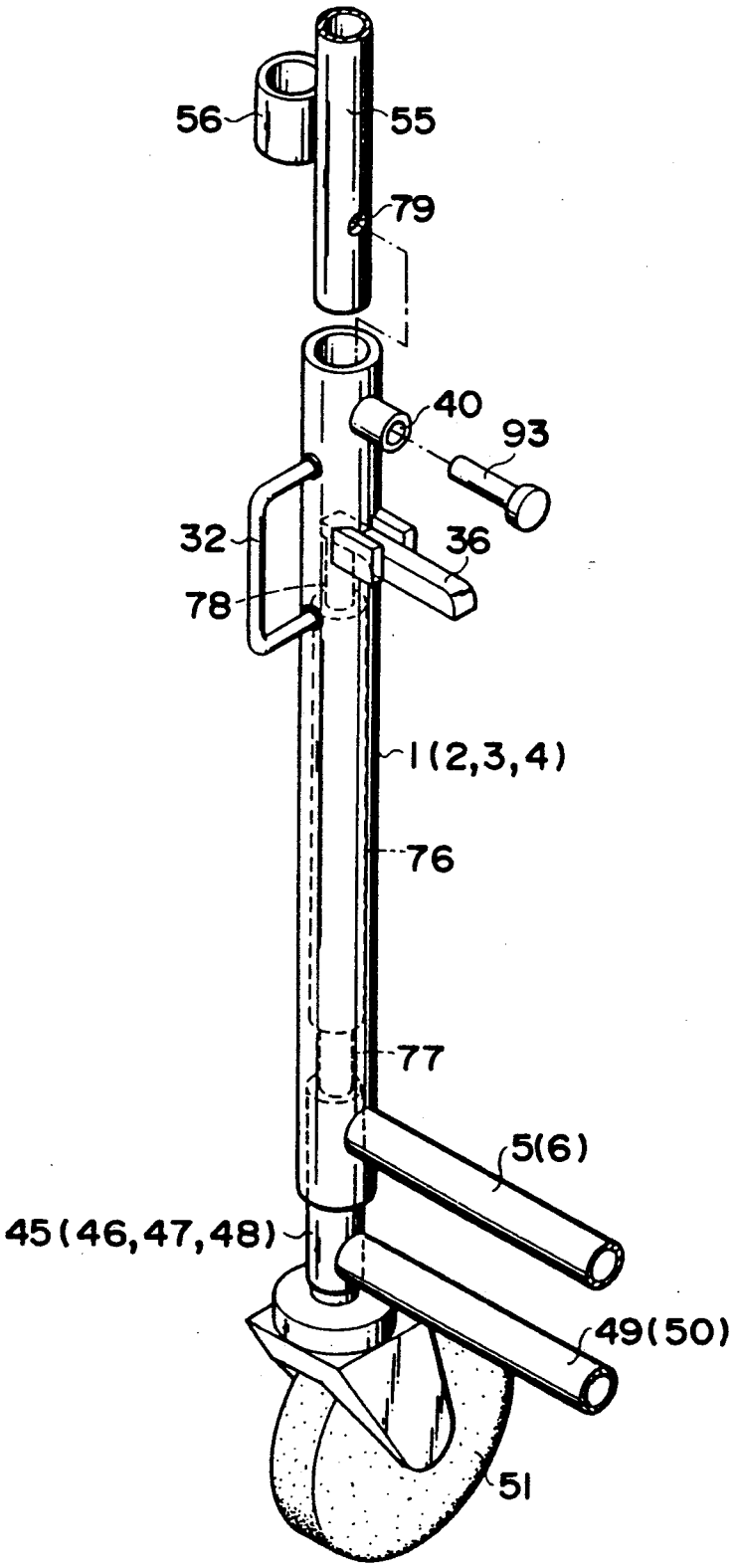
FIG. 5 is a perspective view showing a mechanism for adjusting the height of each pole.
Figure 7:
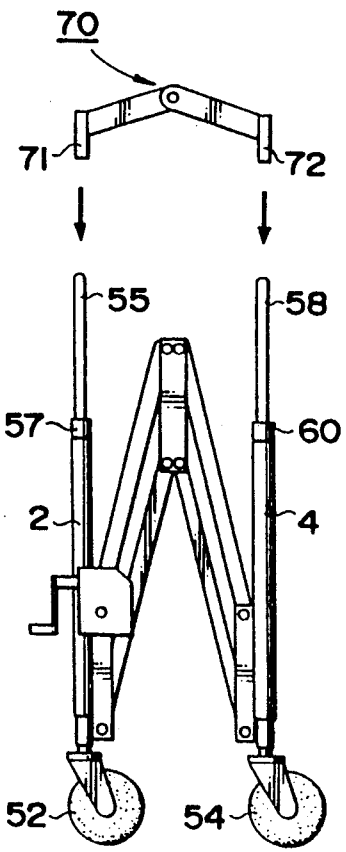
FIGS. 7(A) to 7(C) are views of assistance in explaining the sequence of folding operations of the folding scaffold unit.
Figure 7:
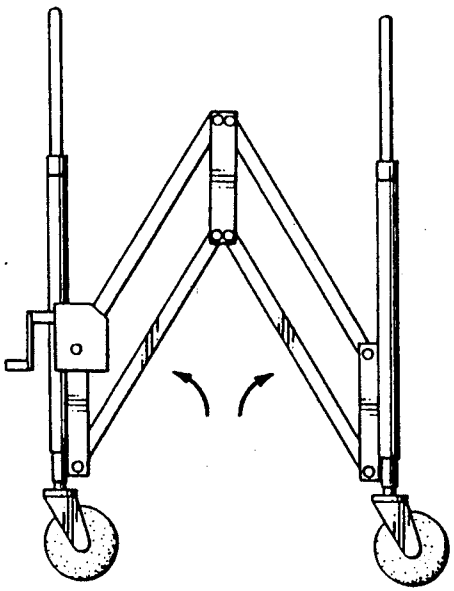
Figure 7:
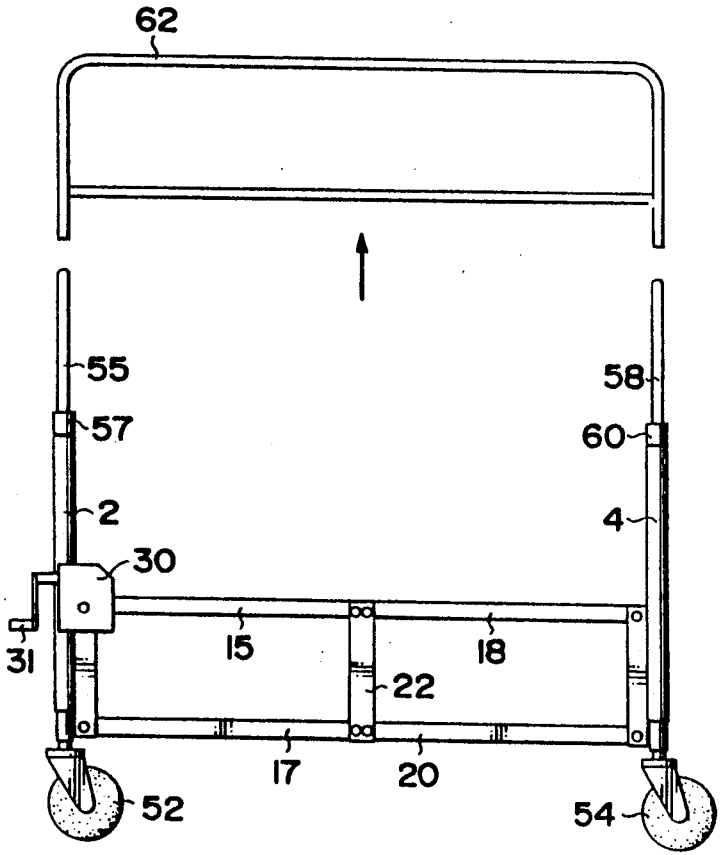

FIG. 5 is a view showing an internal structure of each pole in detail.

There is fixedly provided a gas spring 76 inside the pole 1 which is provided with a rod 77 directed downward and a release pin 78 at the upper end thereof. The lower end of rod 77 is connected to the upper end of the leg supporter 45. The release pin 78 is protruded from the upper end of the gas spring 76 for controlling the air under pressure inside the pole 1 and contacts a lower surface of one end of the lever 36. A fixing pin 93 is removably inserted into the pin hole 40. If the lengthwise handrail 55 is inserted into the pole 1, the fixing pin 93 is inserted into the pin hole 79 so that the pole 1 and the lengthwise handrail 55 are fixedly connected with each other.

Figure 6:
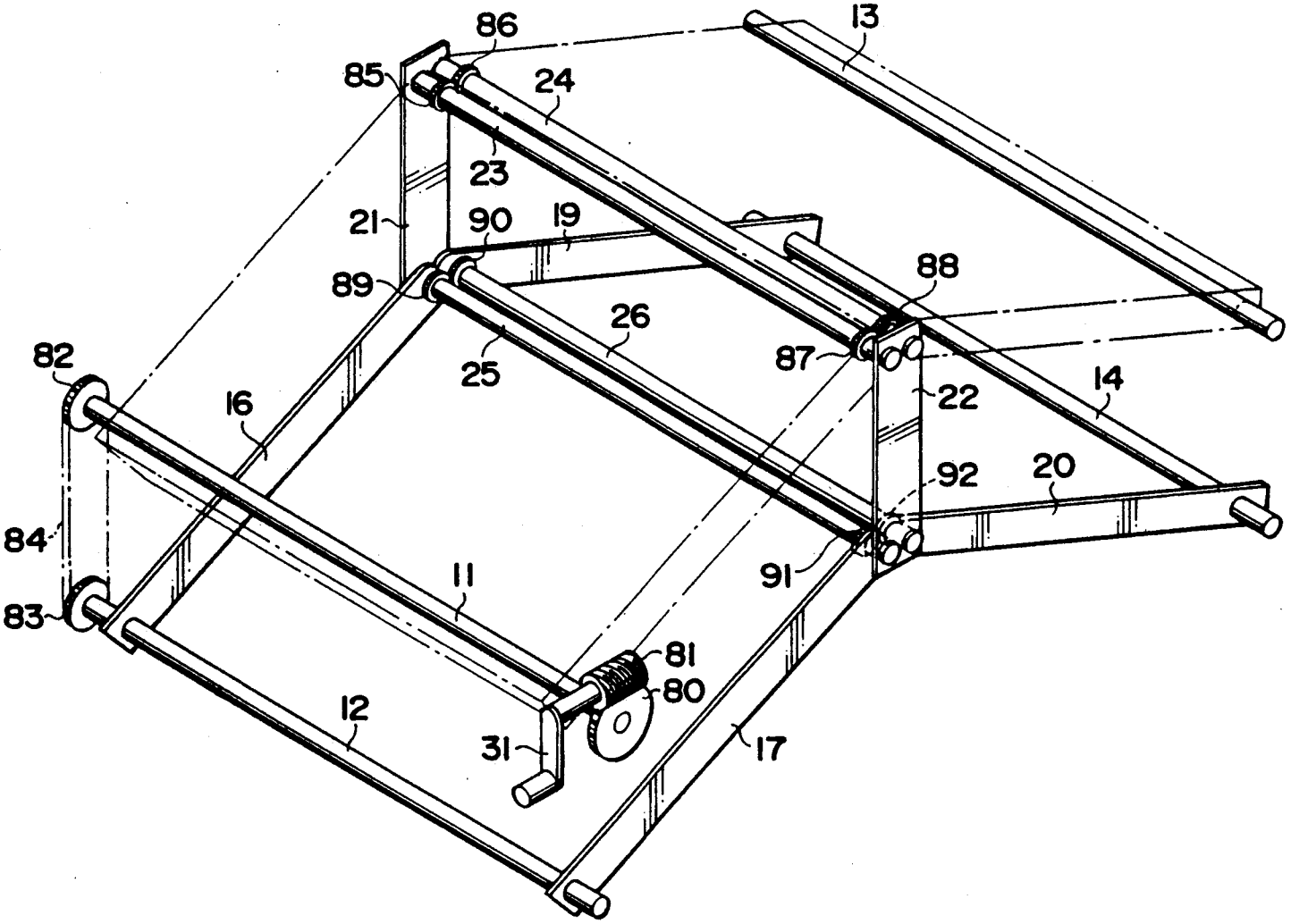
FIG. 6 is a view showing a driving system of the scaffold unit.

FIG. 6 is a view of assistance in explaining a driving system of the folding scaffold unit.

The worm gear 80 is fixed to one end of the shaft 11 and housed in the gear box 30. The worm gear 80 meshes with the worm 81 housed in the gear box 30. The worm 81 can be rotated by the handle 31. The sprocket wheel 82 is fixed to the other end of the shaft 11 opposite to the worm gear 80 and the sprocket wheel 83 is fixed to the other end of the shaft 12. A chain 84 is entrained around both the sprocket wheels 82, 83. Inasmuch as the scaffold board 15 is fixed to the shaft 11, if the shaft 11 is rotated the scaffold board 15 is swingable vertically. Inasmuch as the operation plates 16, 17 are connected to the right and left sides of the shaft 12 at one ends thereof, if the shaft 12 is rotated the operation plates 16, 17 are swingable vertically.

The shaft 23, 24 respectively penetrating the link plates 21, 22 are rotatably inserted into the other ends of the scaffold board 15, 18 and the shafts 25, 26 are rotatably inserted into the operation plates 16, 17, 19, 20. Gears 85, 87 are rotatably inserted into the shaft 23 at the portion adjacent to the both ends thereof and fixed to the other end of the scaffold board 15. Gears 89, 91 are rotatably inserted into the shaft 25 at the portion adjacent to the both ends thereof and fixed to the other ends of the operation plates 16, 17. Gears 90, 92 are rotatably inserted into the shaft 26 at the portion adjacent to the both ends thereof and fixed to the other ends of the operation plates 19, 20. The gears 85, 86, the gears 87, 88, the gears 89, 90, and the gears 91, 92 always mesh with each other and rotate synchronously in the opposite direction. Hence, when the scaffold board 15 fixed to the gears 85, 87 is rotated relative to the shaft 23, the gears 86, 88 are rotated in the opposite direction so that the scaffold board 18 fixed to the gears 86, 88 is swingable through the same angular interval in the direction opposite to the scaffold board 15. Accordingly, the scaffold boards 15, 18 can move aslant upwardly, i.e. move into a chevron shape.

An operation of the folding scaffold unit according to the present invention will be described hereafter.

Figure 3:
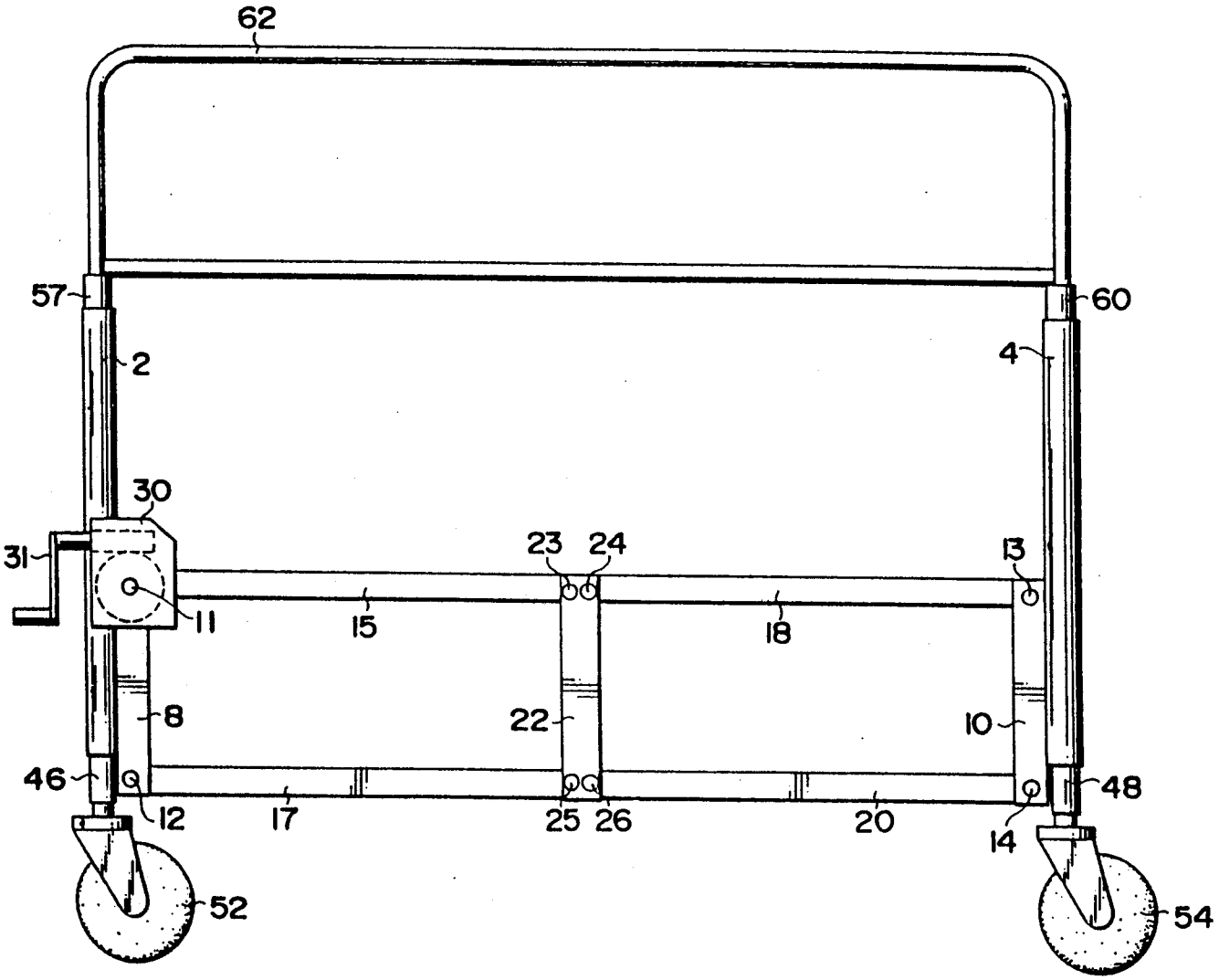
FIG. 3 is a side view showing a state where the folding scaffold unit is unfolded.
Figure 4:
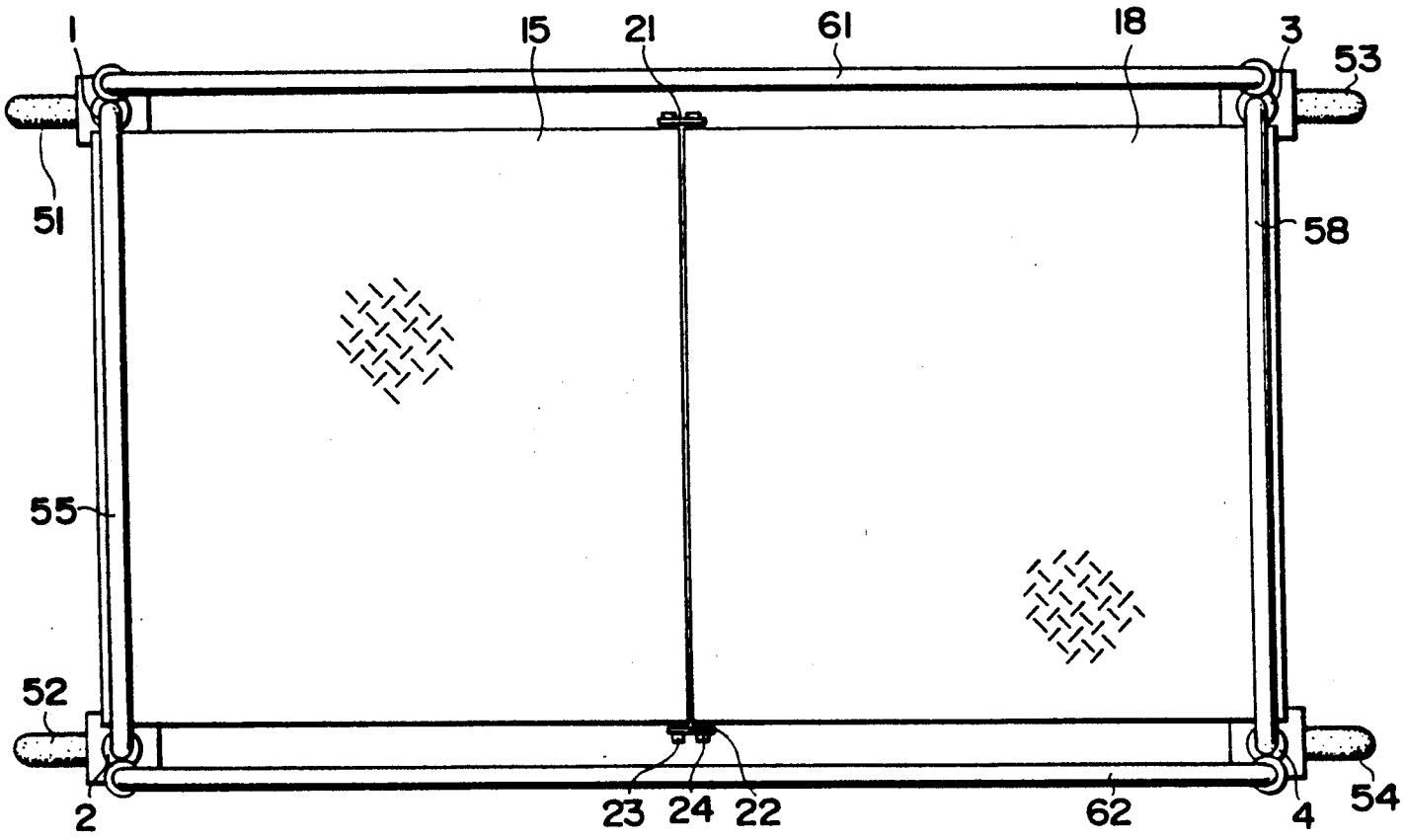
FIG. 4 is a plan view of the folding scaffold unit of FIG. 3.

At the state where the folding scaffold unit is used as illustrated in FIGS. 1 and 3, the scaffold boards 15, 18 are horizontally positioned and the interval between the poles 1, 3 and the poles 2, 4 is the maximum extent. The lengthwise handrail 55 is engaged in the poles 1, 2 while the lengthwise handrail 58 is engaged in the poles 3, 4. The widthwise handrail 61 is engaged in the joints 56, 59 while the widthwise handrail 62 is engaged in the joints 57, 60.

At this state, the worker gets on the scaffold boards 15, 18 and is engaged in constructing, repairing, painting the wall of the structure, and the like. After completion of the working within the scope of the arms' length, the worker moves the scaffold unit on the road surface or the floor along the wall of the structure by pushing or pulling the grips 32, 33, 34, 35 to rotate the casters 51, 52, 53, 54. Hence, when the working is successively continued from one end along the longitudinal direction of the wall furnace, the folding scaffold unit is moved for each length of the scaffold boards 15, 18.

If the heights of the scaffold boards 15, 18 need to be adjusted, the levers 36, 37, 38, 39 respectively fixed to the poles 1, 2, 3, 4 are operated to thereby change the heights of the scaffold boards 15, 18 relative to the road surface or the floor. That is, if the levers 36, 37, 38, 39 are pivoted upward, the inner ends of the levers 36, 37, 38, 39 push down against the head of the release pin 78 so that the air under pressure in the gas spring 76 is discharged. Upon discharge of the air under pressure, the rod 77 is pushed inside the gas spring 76 against a resilience force of the springs housed in the gas spring 76 so that the leg supporters 45, 46, 47, 48 enter into the poles 1, 2, 3, 4. Accordingly, the heights of the scaffold boards 15, 18 can be adjusted since the heights from the casters 51, 52, 53, 54 to the upper surfaces of the scaffold boards 15, 18 are reduced. If the heights of the scaffold boards 15, 18 are needed to be increased, it is necessary not to apply any load on the scaffold boards 15, 18 by removing workers and materials from the scaffold boards 15, 18. Thereafter, the levers 36, 37, 38, 39 are pivoted upward. Successively, the rod 77 is pushed down by the resilience force of the spring housed in the gas spring 76 so that the leg supporters 45, 46, 47, 48 are pushed down so as to extend from the poles 1, 2, 3, 4. Accordingly, the heights from the road surface or the floor to the upper surfaces of the scaffold boards 15, 18 can be increased. These are known methods for increasing or decreasing the heights.

A folding operation of the folding scaffold unit will be described with reference to FIGS. 7(A) to 7(C).

FIG. 7(A) is a view of assistance in explaining a state just after the completion of usage of the folding scaffold unit.

Firstly, the scaffold boards 15, 18 are kept horizontal. The widthwise handrails 61, 62 are removed from the joints 56, 59, 57, 60.

Secondly, the handle 31 is rotated to start the folding operation. Upon rotation of the handle 31, the worm 81 is rotated. The worm gear 80 is rotated by the rotation of the worm 81. Inasmuch as the scaffold board 15 is fixed to the shaft 11 at one end thereof, the scaffold board 15 is gradually raised upward when the shaft 11 is rotated by the worm gear 80. The rotation of the shaft 11 is transmitted to the shaft 12 via the sprocket wheel 82, the chain 84, and the sprocket wheel 83 whereby the shaft 12 is rotated at the angular interval the same as that of the shaft 11. Hence, the operation plates 16, 17 fixed to the shaft 12 are kept in the same angular relation as that of the scaffold board 15 and are thereby raised upward.

Inasmuch as the gears 85, 87 are fixed to the scaffold board 15 at right and left sides of the other end thereof and the gear 87 meshes with the gear 88, the gears 86, 88 opposite to the gears 85, 87 are varied in their contact positions when the scaffold board 15 is raised. The gears 85, 87 are rotated through an angular interval the same as that of the gears 86, 88 so that the scaffold board 18 is raised as a whole through an angular interval the same as that of the scaffold board 15.

Thirdly, simultaneously with the upward movement of both the scaffold boards 15, 18, the gears 90, 92 opposed to the gears 89, 91 are varied in their contact position since the gears 89, 91 are fixed to the other ends of the operation plates 16, 17 while the gear 90 meshes with the gear 89 and the gear 92 meshes with the gear 91 so that the operation plates 16, 17 are raised. Accordingly, the operation plates 19, 20 are likewise raised through an angular interval the same as that of the operation plates 16, 17.

FIG. 7(B) is a view showing the state where the scaffold boards 15, 18 are raised midway and the operation plates 16, 17, 19, 20 are likewise raised midway. If the state as illustrated in FIG. 7(B) is viewed from the side, the parallelogram formed by the shafts 11, 12, 23, 25 is similar to the parallelogram formed by the shafts 13, 14, 24, 26 so that the inclination angle formed by the scaffold boards 15, 18 is always the same angle relative to the road surface or floor and move similar to a fan. Since the casters 51, 52, 53, 54 are rotatable on the road surface or floor, the confronted poles 1, 3 and 2, 4 are moved toward each other so that the folding scaffold unit moves as a whole to reduce the width thereof.

Further rotation of the handle 31 allows the poles 1, 3 and 2, 4 to be moved toward each other to the maximum extent and the inclination angle of the scaffold boards 15, 18 becomes maximum as illustrated in Figure 7(C). Since the scaffold boards 15, 18 and the operation plates 16, 17, 19, 20 each has a predetermined thickness, the inclination angle of the scaffold boards 15, 18 cannot be increased further. The width of the folding scaffold unit in the state as illustrated in FIG. 7(C) is reduced to at least one fourth of that in the state as illustrated in FIG. 7(A). The connecting members 70, 70 are connected to the poles 1, 3 and 2, 4 to prevent the poles 1, 3 and 2, 4 from moving away from each other from the security point of view and not to apply a greater load to the worm 81 and the worm gear 80. The connection is made by engaging the pins 71, 71, 72, 72 of the connecting members 70, 70 with the joints 56, 59, 57, 60 and auxiliary connecting the poles 1, 3 and 2, 4 by the bars 73, 74.

FIGS. 7(A) to 7(C) illustrate the folding process, namely, the process of folding from the state where the width of the folding scaffold unit is a maximum as illustrated in FIG. 7(A) to the state where the width of the folding scaffold unit is a minimum as illustrated in FIG. 7(C). However, the folding scaffold unit can be unfolded by a process opposite to the process mentioned above.

The folding scaffold unit having the structure and functions set forth above has the following effects.

It is not necessary to fabricate the folding scaffold unit by assembling a plurality of members and the unfolding scaffold unit can be fabricated with ease at the working site.

The working operation can be simplified and the working efficiency can be increased since the scaffold boards can be folded by operating the handle.

Furthermore, inasmuch as the size of the folding scaffold unit is reduced when it is folded, it can be accommodated in a warehouse after it is maintained and inspected, and it is possible to accommodate many folding scaffold units which permits maintenance and supervision thereof with ease.

Although the invention has been described in its preferred form with a certain degree of particularity, it is to be understood that many variations and changes are possible in the invention without departing from the scope thereof.

What is claimed is:

1. A folding scaffold unit comprising:

a first pair of parallel poles respectively positioned perpendicular to a floor and a second pair of parallel poles respectively positioned perpendicular to the floor;

the first and second parallel poles being spaced opposite to and in parallel with each other;

the first pair of parallel poles having a first horizontal connecting rod for connecting thereof and first and second horizontal shafts inserted thereinto at upper and lower portions thereof;

the second pair of parallel poles having a second horizontal connecting rod for connecting thereof and third and fourth horizontal shafts inserted thereinto at upper and lower portions thereof;

a first scaffold board having a flat shape being fixed to the first horizontal shaft and a second scaffold board having a flat shape being fixed to the third horizontal shaft;

first and second operation plates being fixed to right and left sides of the second horizontal shaft, the first and the second operation plates having respectively the same length of the first scaffold board;

third and fourth operation plates being fixed to right and left sides of the fourth horizontal shaft, the third and the fourth operation plates having respectively the same length of the second scaffold board;

fifth and sixth horizontal shafts being respectively mounted to the first and the second scaffold boards adjacent the confronting edges thereof and parallel with the respective first and the third horizontal shafts;

a seventh horizontal shaft being fixed to both ends of the first and the second operation plates;

an eighth horizontal shaft being fixed to both ends of the third and the fourth operation plates;

first and second links having the fifth and the sixth horizontal shafts rotatably connected at an upper portion thereof and adjacent right and left sides of the scaffold boards, the first and the second links further having the seventh and the eighth horizontal shafts connected at a lower portion thereof and adjacent right and left sides of the first to fourth operation plates; and first and second gears being mounted to the fifth horizontal shaft and fixed relative to the first scaffold board, and third and fourth gears being mounted to the sixth horizontal shaft and fixed relative to the second scaffold board, the first and second gears having teeth and the third and fourth gears having teeth which mesh with the teeth of the respective first and second gears.

2. A folding scaffold unit according to claim 1, wherein one of the first pair of poles has a driving mechanism at one end thereof for rotating the first horizontal shaft.

3. A folding scaffold unit according to claim 2, wherein the driving mechanism comprises a worm gear fixed to the first horizontal shaft, a worm meshing with the worm gear, and a handle for rotating the worm.

4. A folding scaffold unit according to claim 1, including the seventh horizontal shaft having fifth and sixth gears and the eighth horizontal shaft having seventh and eight gears, the fifth and sixth gears having teeth and the seventh and eighth gears having teeth which mesh with the teeth of the respective fifth and sixth gears.

5. A folding scaffold unit according to claim 1, further comprising a belt entrained around ninth and tenth gears fixed to the first and the second horizontal shafts.

6. A folding scaffold, unit according to claim 1, further comprising leg supporters mounted at lower ends of each of the first and second parallel poles and casters each rotatably connected to the leg supporters.

7. A folding scaffold unit according to claim 1, further comprising lengthwise handrails insertable into the first and second pairs of parallel poles, the lengthwise handrails each having joints and pin holes, pins inserted into the pin holes when the lengthwise handrails are inserted into the first and the second pairs of parallel poles, and widthwise handrails insertable into the joints of the lengthwise handrails.

8. A folding scaffold unit according to claim 1, wherein the first and the second parallel poles have gas springs therein, each gas spring provided with a release pin at an upper end thereof and a rod at the lower end thereof.

9. A folding scaffold unit according to claim 8, wherein the first and the second pairs of parallel poles have grips at the upper portions thereof.

10. A folding scaffold unit according to claim 9, wherein the first and the second pairs of parallel poles have levers adjacent to the grips for pushing down the upper ends of the release pins so that the heights of the first and the second scaffold boards can be adjusted.

11. A folding scaffold unit comprising:

a frame means including a pair of first upright rod assemblies extending generally vertically and being disposed in generally parallel and sidewardly spaced relation, a pair of second upright rod assemblies extending generally vertically and disposed in generally parallel and sidewardly spaced relation, each of said upright rod assemblies including vertically elongate upper and lower rods which slidably telescope with respect to one another, lifting means coacting between the respective upper and lower rods for permitting the upper rod to be vertically raised relative to the lower rod, and a roller mounted on a lower end of said lower rod for rolling engagement with a support surface such as a floor, a pair of connecting elements, one of said connecting elements extending between the lower rods of said first pair for rigidly joining said lower rods together, and the other connecting element extending rigidly between the lower rods of said second pair for rigidly joining said lower rods together;

first and second scaffold boards having an enlarged and generally flat upper surface, said first scaffold board having one end edge thereof disposed so as to extend generally horizontally between and being vertically pivotally supported on the upper rods of said first rod assemblies, and the second scaffold board having an end edge thereof extending generally horizontally between and vertically pivotally supported on the upper rods of said second rod assemblies, the other end edge of said first scaffold board being disposed and maintained in close proximity to the other end edge of said second scaffold board;

a pivotal linkage disposed adjacent one side of said first and second scaffold boards and extending between and being pivotally connected to the upper rods of the first and second rod assemblies and to the first and second scaffold boards adjacent the other end edges thereof, said pivotal linkage being movable between (1) an extended position wherein the pairs of first and second rod assemblies are spaced a maximum distance apart and the first and second scaffold boards are disposed horizontally and in side-by-side relationship to define an enlarge upwardly-directed support platform and (2) a collapsed position wherein the linkage angles upwardly in a generally inverted V-shaped configuration so that the first and second pairs of upright rod assemblies are disposed closely adjacent and the first and second scaffold boards are maintained in a collapsed position having a generally inverted V-shaped configuration; and a driving mechanism cooperable with said pivotal linkage for positively driving said pivotal linkage from one of said extended and collapsed positions into the other of said extended and collapsed positions, said driving mechanism including force application means for permitting a driving force to be applied to said driving mechanism, said force application means being mounted on said frame means at a vertical elevation which is independent of the position of said pivotal linkage.

12. A scaffold unit according to claim 11, including a pair of horizontally elongate and rigid side handrail members adapted to be positioned adjacent opposite sides of the scaffold unit, each said handrail member extending between and being stationarily but removably coupled to upper ends of the upper rods defined on opposed first and second rod assemblies when the linkage is in said extended position.

13. A scaffold unit according to claim 12, including a temporary coupling assembly disposed adjacent one side of said scaffold unit for holding said scaffold unit in the collapsed position, said temporary coupling assembly extending between and being stationarily but removably coupled to upper ends of the upper rods associated with the opposed first and second rod assemblies.

14. A scaffold unit according to claim 11, wherein said pivotal linkage includes first and second plates disposed respectively under said first and second scaffold boards and arranged in parallel with said first and second scaffold boards, each of said first and second plates having one end pivotally connected to one of said upper rods of the respective first and second upright rod assemblies, an elongate link plate extending vertically and having an upper end pivotally connected to said other end edges of said first and second scaffold boards and a lower end pivotally connected to the other ends of said first and second plates;

the first scaffold board, the first plate, the link plate, and the upper rod to which the first plate is connected forming a parallelogram; and said force application means including a rotatable drive gear, and said driving mechanism including a rotatable driven gear which is drivingly connected to said drive gear.

15. A folding scaffold unit, comprising:

a frame means;

a pair of generally flat scaffold boards normally supported on said frame means in generally adjacent and coplanar relationship, said scaffold boards having mutually opposed edges and being pivotally supported on said frame for vertical pivotal movement about respective generally horizontal pivot axes which are spaced oppositely away from said opposed edges;

means for effecting vertical pivotal movement of one of said scaffold boards about the associated pivot axis;

pivotal link means connected between said opposed edges of said scaffold boards for pivotally connecting said boards to one another; and means responsive to said vertical pivotal movement of said one scaffold bards for causing the other scaffold board to pivot vertically about its own axis in angular registry with said vertical pivotal movement of said one scaffold board, including a generally arcuate arrangement of vertically spaced teeth fixedly provided on each scaffold board adjacent said opposed edge thereof and operatively meshing with the teeth of the other scaffold board.

* * * * *

UNITED STATES PATENT AND TRADEMARK OFFICE

CERTIFICATE OF CORRECTION

PATENT NO. : 5 121 812

DATED : June 16, 1992

INVENTOR(S) : Minoru Ochiai et al

It is certified that error appears in the above-identified patent and that said Letters Patent is hereby corrected as shown below:

Column 8, line 41; change "scaffold, unit" to ---scaffold unit---.

Column 10, line 54; change "bards" to ---board---.

Signed and Sealed this

Twenty-first Day of September, 1993

Bruce Lehman

*Attest:*

BRUCE LEHMAN

*Attesting Officer*

*Commissioner of Patents and Trademarks*